United States Patent [19]

Hashimoto et al.

[11] Patent Number: 4,855,787

[45] Date of Patent: Aug. 8, 1989

[54] IMAGE DUPLICATING APPARATUS HAVING PLURAL COPYING MODES AND PLURAL SHEET FEEDING ARRANGEMENTS

[75] Inventors: Kaoru Hashimoto; Hirohisa Miyamoto, both of Osaka, Japan

[73] Assignee: Minolta Camera Kabushiki Kaisha, Osaka, Japan

[21] Appl. No.: 149,164

[22] Filed: Jan. 27, 1988

[30] Foreign Application Priority Data

Jan. 28, 1987 [JP] Japan ..... 62-18052

[51] Int. Cl.[4] ..... B65H 7/02; G03G 15/00

[52] U.S. Cl. ..... 355/311; 271/259; 355/24; 355/319

[58] Field of Search ..... 271/65, 186, 258, 259; 355/3 SH, 14 SH, 23, 24, 26

[56] References Cited

U.S. PATENT DOCUMENTS

| | | | |
|---|---|---|---|
| 4,190,246 | 2/1980 | Sasuga | 355/3 SH X |
| 4,265,440 | 5/1981 | Shibazaki et al. . | |
| 4,365,886 | 12/1982 | Murakami et al. . | |
| 4,647,188 | 3/1987 | Komiya et al. | 355/14 R X |
| 4,721,382 | 1/1988 | Ito et al. . | |
| 4,730,206 | 3/1988 | Sawada et al. | 355/3 SH |
| 4,763,889 | 8/1988 | Dei et al. | 271/259 X |

FOREIGN PATENT DOCUMENTS

| | | | |
|---|---|---|---|
| 0026061 | 2/1986 | Japan | 355/24 |

*Primary Examiner*—Arthur T. Grimley
*Assistant Examiner*—Edward Pipala
*Attorney, Agent, or Firm*—Burns, Doane, Swecker & Mathis

[57] ABSTRACT

An image duplicating apparatus having optical scanning and image reproducing stages for reproducing images on a sheet medium, a plurality of sheet feeding stages each for feeding a sheet medium to the image reproducing stage, the sheet feeding stages being respectively operative to store sheet media of different sizes, a first size indicating device for indicating the size of the sheet media stored in each of the sheet feeding stages, a first controller for controlling the optical scanning and image reproducing stages so that the image reproducing stage reproduces images on one of the opposite faces of a sheet medium fed from one of the sheet feeding stages, a sheet recovery and supply stage for temporarily storing the sheet medium having images reproduced on one of its faces under the control of the first controller and thereafter supplying the sheet medium for a second time to the image reproducing stage, a second controller for controlling the optical scanning and image reproducing stages so that the image reproducing stage reproduces images on the other face of the sheet medium supplied from the sheet recovery and supply stage, a second size indicating device for indicating the size of the sheet media which can be stored in the sheet recovery and supply stage, and a sheet-feed selecting device for comparing the sizes of sheet media respectively indicated by the first and second size indicating device and automatically selecting the particular one of the sheet feeding stages that stores sheet media of the size identical with the size of sheet media indicated by the second size indicating device.

23 Claims, 6 Drawing Sheets

IMAGE DUPLICATING APPARATUS HAVING PLURAL COPYING MODES AND PLURAL SHEET FEEDING ARRANGEMENTS

FIELD OF THE INVENTION

The present invention relates to an image duplicating apparatus and particularly to an electrophotographic image duplicating apparatus such as a copying apparatus of the type having a duplex mode of copying operation in which images are to be printed on the opposite faces of a copy sheet in two consecutive cycles of operation.

BACKGROUND OF THE INVENTION

An electrophotographic copying apparatus having a duplex copying function is known which is useful for saving the number of the copy sheets to be consumed and the space required for the preservation of the duplicate documents. In a copying apparatus of this type, images are printed on one face of a copy sheet during a first cycle of copying operation, followed by a second cycle of copying operation by which images are further printed on the opposite face of the copy sheet. During the latter cycle of copying operation, the copy sheet bearing the printed images on one face thereof is turned upside down before the sheet is brought into contact with the photosensitive drum. In order to automate such a sheet reversing function, a known copying apparatus having a duplex function has an intermediate copy-sheet recovery stage for temporarily storing the copy sheet on which images have been printed during the former cycle of copying operation. The latter cycle of copying operation for the reverse face of the copy sheet is thus started with the copy sheet supplied from such an intermediate copy-sheet recovery stage. An extra duplex copy-sheet supply tray is thus provided at the intermediate copy-sheet recovery stage for receiving the copy sheet bearing the printed images on one face and thereafter supplying the copy sheet for the second cycle of copying operation. Such a duplex copy-sheet supply tray may be detachably assembled to the copying apparatus when it is desired to perform a duplex mode of copying operation and is selected from among some trays which are respectively allocated to predetermined sizes of copy sheets.

In a copying apparatus of this type, it may happen that the duplex copy-sheet supply tray fails to properly conform to the size of the copy sheet transported to the intermediate copy-sheet recovery stage. When this occurs, the copy sheet transported to the intermediate copy-sheet recovery stage can not be correctly received by the duplex copy-sheet supply tray and might cause jamming that will put an end to the intended duplex copying operation abortively or will lead to a more serious failure of the apparatus.

In a copying apparatus having an intermediate copy-sheet recovery stage, it is thus important to confirm and assure that the duplex copy-sheet supply tray currently assembled to the apparatus properly conform to the size of the copy sheet to be supplied from the main copy-sheet supply stage of the apparatus. The operator of the apparatus is for this reason required to make such a confirmation each time he desires to perform a duplex mode of copying operation.

One approach to providing a solution to this problem may be to prohibit the apparatus from carrying out a duplex mode of operation while producing any warning signal when it is found that there is a discrepancy between the duplex copy-sheet supply tray in use and the size of the copy sheet selected to be used. This approach is useful for the prevention of the jamming but still requires the operator to take any time-consuming actions on the control panel to remove such a discrepancy.

SUMMARY OF THE INVENTION

The present invention contemplates elimination of these and other problems which have thus far been inherent in an image duplicating apparatus of the described type. It is accordingly an important object of the present invention to provide an image duplicating apparatus having a duplex mode of copying operation eliminating the discrepancy between the duplex copy-sheet supply tray in use and the size of the copy sheet selected to be used.

In accordance with an important aspect of the present invention, there is provided an image duplicating apparatus, comprising (a) means for reproducing images on a sheet medium, (b) a plurality of sheet feeding means each for feeding a sheet medium to the image reproducing means, the sheet feeding means being respectively operative to store sheet media of different predetermined sizes, (c) first size indicating means for indicating the size of the sheet media stored in each of the plurality of sheet feeding means, (d) first control means for controlling the image reproducing means so that the image reproducing means reproduces images on one of the opposite faces of a sheet medium fed from one of the plurality of sheet feeding means, (e) sheet recovery and supply means for temporarily storing the sheet medium having images reproduced on one of its faces under the control of the first control means and thereafter supplying the sheet medium for a second time to the image reproducing means, (f) second control means for controlling the image reproducing means so that the image reproducing means reproduces images on the other face of the sheet medium supplied from the sheet recovery and supply means, (g) second size indicating means for indicating the size of the sheet media which can be stored in the sheet recovery and supply means, and (h) sheet-feed selecting means for comparing the size of sheet media indicated by the first size indicating means and the size of sheet media indicated by the second size indicating means and automatically selecting the particular one of the plurality of sheet feeding means that stores sheet media of the size identical with the size of sheet media indicated by the second size indicating means.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

Figure 1:
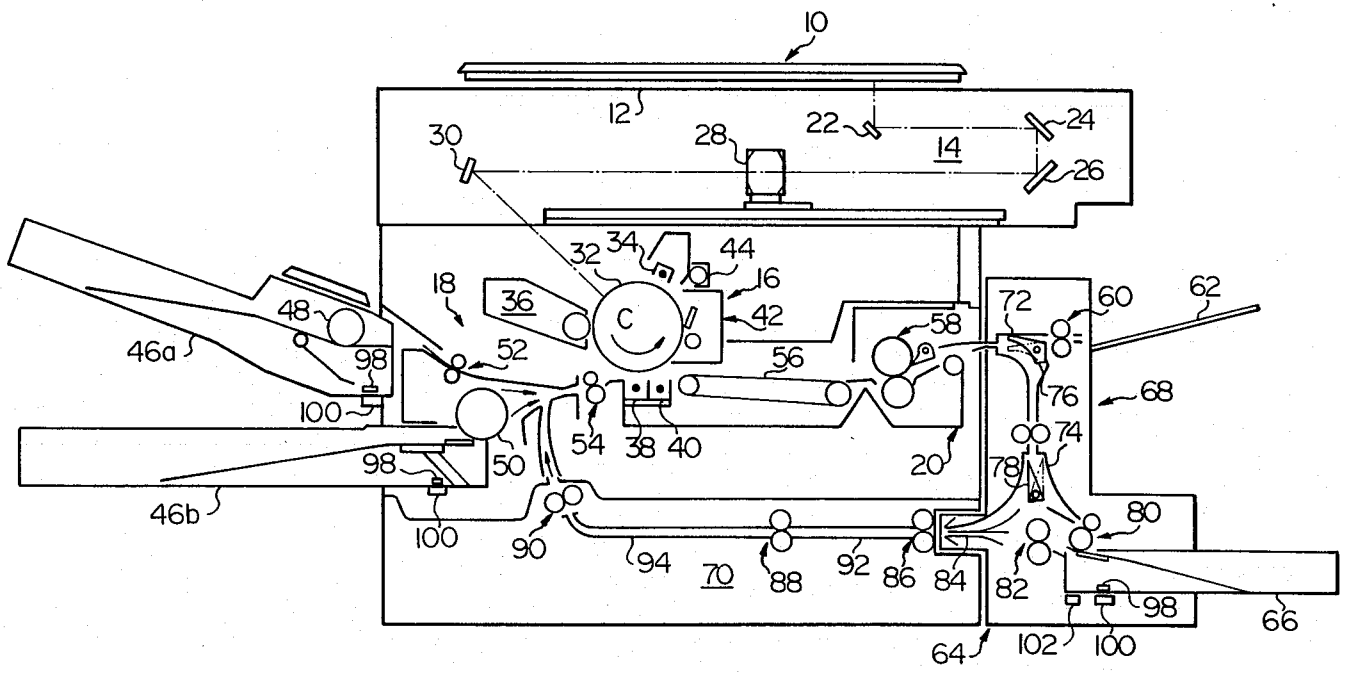
FIG. 1 is a side elevation view showing the general mechanical construction and arrangement of a preferred embodiment of an image duplicating apparatus according to the present invention.

As shown in FIG. 1, an image duplicating apparatus (hereinafter referred to as copying apparatus) embodying the present invention comprises a main housing 10 having an upper panel portion formed in part by a transparent document table 12. A sheet of document (not shown) bearing images to be reproduced is to be placed on this document table 12.

During duplication operation of the apparatus, the document sheet placed on the document table 12 is optically scanned by means of an optical scanning system 14. A beam of light carrying information representative of the images thus picked up from the document sheet is directed to an image reproduction system 16. By means of this image reproduction system 16, the images carried by the light beam are provisionally recorded in the form of latent images, which are then developed into visible toner images through an electrophotographic process. The visible toner images are transferred to a copy sheet transported by a copy sheet feed system 18 whereupon the copy sheet carrying the reproduced images is withdrawn out of the apparatus by means of an image-fixing and sheet discharge system 20.

The optical scanning system 14 comprises an exposure lamp (not shown) from which a beam of light is incident on and reflected from the lower face of the document sheet on the table 12. The light reflected from the document sheet is incident onto an object mirror 22 and is re-directed rearwardly therefrom, the lamp and mirror implementing, in combination, a document scanner in the image duplicating apparatus embodying the present invention. The document scanner is movable forwardly and backwardly along the document table 12. The light reflected from the object mirror 22 is re-directed toward a mirror 24, which further re-directs the light downwardly toward another mirror 26. The mirrors 24 and 26 are also movable together along the document table 12. From the mirror 26, the light travels forwardly along the document table 12 and passes through an image magnification/reduction lens unit 28 to a mirror 30. The lens unit 28 is movable along the document table 12 independently of the document scanner and mirror pair 24/26 with respect to the table 12. The mirror 30 then redirects the light toward the image reproducing system 16.

The image reproducing system 16 of the apparatus comprises a cylindrical photosensitive drum 32 having a photoconductive peripheral surface. The light reflected downwardly from the projecting mirror 30 is projected onto the peripheral surface of this photosensitive drum 32. The drum 32 is rotatable about its center axis in a direction indicated by arrow c and is driven for rotation at a fixed peripheral speed. Movement of the lens unit 28 in either direction with respect to the mirror 30 results in a change in the magnification/reduction ratio of the images to be reproduced. The image reproducing system 16 further comprises a main charger 34 to sensitize the photoconductive peripheral surface of the photosensitive drum 32. Posterior to the path of light from the mirror 30 to the drum 32 is located an image developing stage 36 including at least one developing unit having a stock of a developer powder composed of a mixture of carrier particles and black or otherwise colored toner particles. Posterior to the developing stage 36 in turn is provided an image transfer charger 38 which is operative to charge the copy sheet so that the toner images formed on the drum 32 are transferred to the copy sheet. The copy sheet thus having the toner images carried thereon is separated from the drum 32 by means of a separation charger 40 which is located posterior to the transfer charger 38. There is further provided a drum cleaner unit 42 which removes any residual toner particles from the peripheral surface of the drum 32. Posterior to this cleaner unit 42 in turn is located a charge eraser lamp 44 which irradiates the cleaned peripheral surface of the drum 32 to eliminate the charges which may be left thereon.

The copy-sheet feed system 18 of the apparatus comprises first and second main copy-sheet supply stages where cassettes **46*a* and 46*b* storing copy sheets of different sizes are detachably fitted to the housing 10 through slots provided in one side panel portion of the housing 10. At these main copy-sheet supply stages are further provided first and second copy-sheet feed rollers 48 and 50 associated with the cassettes 46*a* and 46*b*, respectively, each for picking up copy sheets one after another from the stack of copy sheets in the associated cassette 46*a* or 46*b*. A copy sheet picked up from the cassette 46*a* at the first main copy-sheet supply stage by means of the fee roller 48 is passed through a pair of guide rollers 52 toward a pair of timing rollers 54 located immediately anterior to the charger 38. A copy sheet picked up from the cassette 46*b* at the second main copy-sheet supply stage by means of the feed roller 50 is passed directly toward the timing rollers 54**.

A copy sheet which has been transported from one of the cassettes **46*a* and 46*b* and passed through the timing rollers 54 is brought into contact with the peripheral surface of the drum 32. The timing rollers 54 are driven for rotation at a timing synchronized with the movement of the document scanner so that the copy sheet which has reached the rollers 54 is transferred to the drum 32 at a correct timing. Each of the feed rollers 48 and 50, guide roller pair 52, and timing roller pair 54** is driven from a main drive motor of the apparatus by means of respectively associated clutches (not shown).

A copy-sheet transport belt assembly 56 is positioned posterior to the area where the copy sheet is to be separated from the photosensitive drum 32. The copy sheet separated from the drum 32 is thus conveyed on the belt assembly 56 to an image fixing assembly 58 positioned at the rear of the belt assembly 56. The toner particles carried on the copy sheet are thus thermally fused and the toner images fixed on the copy sheet by means of this image fixing assembly 58. The copy sheet released from the image fixing assembly 58 is withdrawn from the apparatus through a pair of copy-sheet discharge rollers 60 and a copy-sheet discharge tray 62 and through a slot provided in the other panel portion of the housing 10.

The copying apparatus embodying the present invention further comprises a duplex/composite copy-sheet feed system 64 which is detachably provided within the housing 10 for producing printed images on the front or reverse face of the copy sheet which has printed images already produced on its front face. Such a duplex/composite copy-sheet feed system 64 largely comprises an intermediate copy-sheet recovery stage, a three-way select system 68, and a copy-sheet recirculation arrangement 70. At the intermediate copy-sheet recovery stage is provided a duplex copy-sheet supply tray 66 detachably fitted to the system 64 through a slot provided in the right panel portion of the system 64. The three-way select system 68 comprises a first copy-sheet passageway 72 located intermediate between the image fixing assembly 58 and the paper discharge roller pair 60 and a second copy-sheet passageway 74 located below the first copy-sheet passageway 72. In the first copy-sheet passageway 72 is provided a first guide member 76 rockable between a first position allowing a copy sheet to pass to the copy-sheet discharge roller pair 60 and a second position allowing a copy sheet to pass downwardly toward the second copy-sheet passageway 74. The second copy-sheet passageway 74 has provided therein a second guide member 78 rockable between a first position allowing a copy sheet to pass toward the duplex copy-sheet supply tray 66 and a second position allowing a copy sheet to pass toward the copy-sheet recirculation arrangement 70.

During ordinary mode of copying operation in which an image is to be printed on a single face of a copy sheet, the first guide member 76 is held in the first position thereof. Thus, a copy sheet bearing a printed image on its upper face and conveyed to the first copy-sheet passageway 72 is passed through the copy-sheet discharge roller pair 60 to the copy-sheet discharge tray 62. During duplex copying operation in which images are to be printed on the opposite faces of a copy sheet, the first guide member 76 is held in the second position thereof and concurrently the second guide member 78 is held in the first position thereof. Under these conditions, a copy sheet bearing printed images on its upper face and conveyed to the first copy-sheet passageway 72 is passed to the second copy-sheet passageway 74 and is directed to the duplex copy-sheet supply tray 66 for temporary storage therein. During composite copying operation in which images respectively duplicated from two different documents are to be printed on a single face of a copy sheet, both the first guide member 76 and the second guide member 78 are held in the respective second positions thereof. Under these conditions, a copy sheet bearing a printed image on its upper face and conveyed to the first copy-sheet passageway 72 is passed to the second copy-sheet passageway 74 and is directed toward the copy-sheet recirculation arrangement 70.

A pair of guide rollers 80 is provided to guide a copy sheet from the second copy-sheet passageway 74 to the duplex copy-sheet supply tray 66. In association with this duplex copy-sheet supply tray 66 is further provided a pair of rollers 82 for transporting a copy sheet from the tray 66. A copy sheet picked up from the duplex copy-sheet supply tray 66 by means of the lower one of the rollers 80 or a copy sheet passed directly from the second copy-sheet passageway 74 is fed from an outlet passageway 84 which forms part of the system 68. The copy-sheet recirculation arrangement 70 further comprises copy-sheet guide roller pairs 86, 88 and 90 and passageways 92 and 94 intervening between these roller pairs 92 and 94 so that a copy sheet fed from the outlet passageway 84 is transported backwardly and then upwardly toward the timing rollers 54 for a second cycle of copying operation in a duplex or composite copying mode. It will be seen that the copy sheet once stored into the duplex copy-sheet supply tray 66 and thereafter supplied therefrom to the copy-sheet recirculation arrangement 70 has its image bearing face directed upwardly and is thus turned upside down when passed over to the timing rollers 54.

Figure 2:
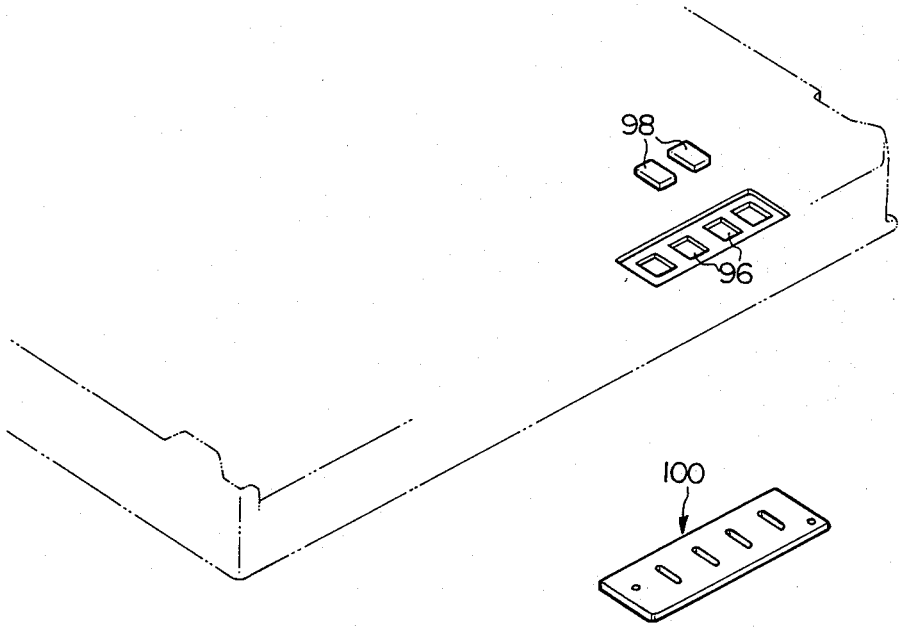
FIG. 2 is a fragmentary perspective view showing an example of the detector switch arrangement which may be provided on each of the copy-sheet supply cassettes and the duplex copy-sheet supply tray provided in the image duplicating apparatus shown in FIG. 1, the detector switch arrangement being operative to indicate the size of the copy sheets stored in each of the cassettes or the tray.

FIG. 2 shows an example of the detector switch arrangement which may be provided on each of the copy-sheet supply cassettes **46*a* and 46*b* and the duplex copy-sheet supply tray 66 provided in the copying apparatus constructed and arranged as hereinbefore described. The detector switch arrangement is provided to determine the type of the cassette or tray, viz., the size of the copy sheets to stored in the particular cassette or tray on which the arrangement is made. Such detector switch arrangement comprises a total of four location indicia which are herein implemented by depressions 96 formed in a panel portion of the cassette or tray structure and arranged in an array in a predetermined direction with respect to the cassette or tray structure. In any two of these four depressions 96 are fitted magnet elements 98 depending on the size of the copy sheets to stored in the particular cassette or tray. A total of six different combinations of magnet locations are thus available with the two magnet elements 98 respectively located in any two of the depressions 96. These different combinations of magnet locations are respectively allocated to different standardized sizes of copy sheets so that each of the combinations represents a particular one of such standardized sizes of copy sheets. Respectively in association with the depressions 96 are provided magnetically actuated reed type switch elements which implement a copy-sheet size detector switch 100 mounted on any structural member of the housing 10 and the system 68. Thus, any one of six different electric signals is produced from the detector switch 100** depending on the particular combination of the magnet locations of the cassette or tray.

At the intermediate copy-sheet recovery stage of the apparatus is further provided a duplex tray detector switch 102 responsive to the presence of the duplex copy-sheet supply tray 66 assembled to the apparatus.

Figure 3:
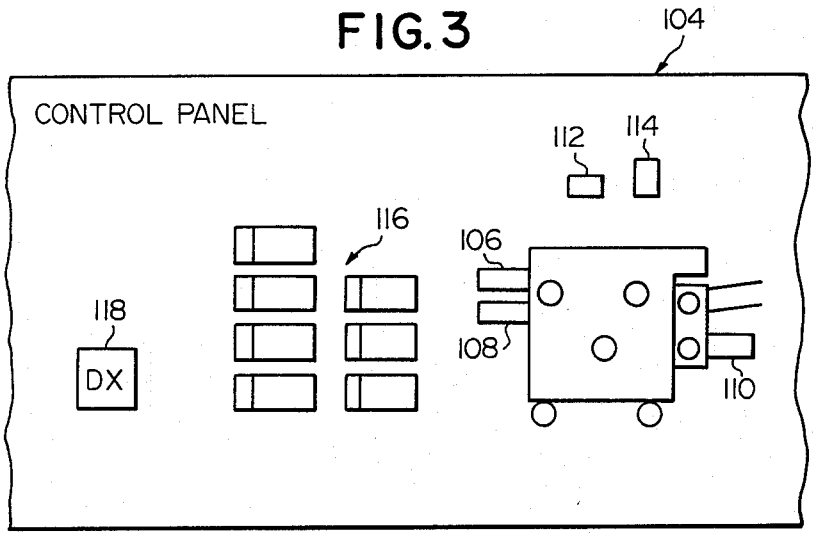
FIG. 3 is a fragmentary plan view showing a portion of the switch and indicator arrangement of a control panel which forms part of the apparatus embodying the present invention.

FIG. 3 shows a portion of the switch and indicator arrangement of a control panel 104 which forms part of the apparatus embodying the present invention. The control panel 104 comprises, in addition to the various switches and indicators which are ordinarily in used for copying apparatus, cassette indicators 106 and 108 respectively associated with the first and second main copy-sheet supply stages and a duplex tray indicator 110 associated with the intermediate copy-sheet recovery stage. Each of these indicators 106, 108 and 110 is turned on to illuminate when the corresponding stage is selected for use or to flicker when there is no cassette or tray installed at the corresponding stage. On the control panel 104 are further provided copy-sheet direction indicators 112 and 114 which indicate whether a copy-sheet is to be fed lengthwise or widthwise and size select switches/indicators 116 for manually selecting the size of copy sheets to be used and indicating the selected size of copy sheets. Further provided on the control panel 104 is a duplex mode select switch 118 for manually selecting a duplex mode of copying operation.

Figure 4:
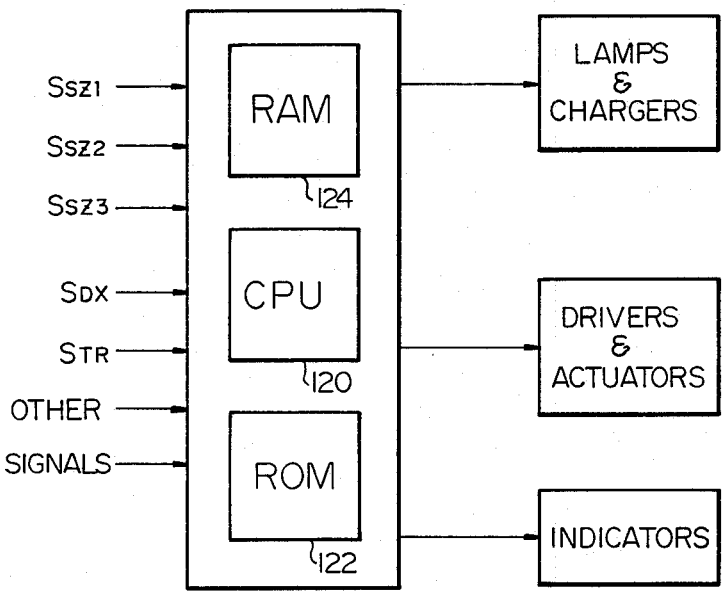
FIG. 4 is a schematic diagram showing the general arrangement of a control circuit which may be used for the execution of copying operation by the apparatus embodying the present invention.

FIG. 4 shows the general arrangement of a control circuit which may be used for the execution of various functions for copying operation in the copying apparatus embodying the present invention. The control circuit comprises a master central processor unit 120 (CPU), a read-only memory 122 (ROM) and a random-access memory 124 (RAM). In the read-only memory 122 are stored the data and programs to dictate the control procedures to be performed by the central processor unit 120.

The central processing unit 120 is predominant over the input and output of various signals from and to the control panel 104 and receive various control and data signals entered from the control panel 104 or produced at various stages of the apparatus. Such control and data signals include a copy-sheet size signal $S_{SZ1}$ indicative of the copy sheet size allocated to the cassette 46*a* installed at the first main copy-sheet supply stage, a copy-sheet size signal $S_{SZ2}$ indicative of the copy sheet size allocated to the cassette 46*b* installed at the second main copy-sheet supply stage, and a copy-sheet size signal $S_{SZ3}$ indicative of the copy sheet size allocated to the tray 66 installed at the intermediate copy-sheet recovery stage. The copy-sheet size signals $S_{SZ1}$ and $S_{SZ2}$ are supplied from the copy-sheet size detector switches 100 provided at the first and second main copy-sheet supply stages, respectively, and the copy-sheet size signal $S_{SZ3}$ is supplied from the copy-sheet size detector switch 100 provided at the intermediate copy-sheet recovery stage. The control and data signals supplied to the central processing unit 120 further include a duplex mode select signal SDX which may be supplied from the duplex mode select switch 118 on the control panel 104 and a signal $S_{TR}$ indicative of the presence of the duplex copy-sheet supply tray 66 assembled to the apparatus, the signal being $S_{TR}$ supplied from the duplex tray detector switch 102.

The signals thus supplied to the central processor unit 120 may be stored in the random-access memory 124 or in the registers incorporated in the central processor unit 120 per se and may be processed in accordance with the data and program stored in the read-only memory 122. From the central processing unit 120 are thus output various signals including those for activating the indicators on the control panel 104, those for activating the various driver and actuator units, and those for activating the lamps and chargers of the document scanning and image reproducing systems 14 and 16. The driver and actuator units include the clutches provided in conjunction with the various feed and guide rollers included in the copy-sheet feed system 18 and duplex/-composite copy-sheet feed system 64.

Figure 5:
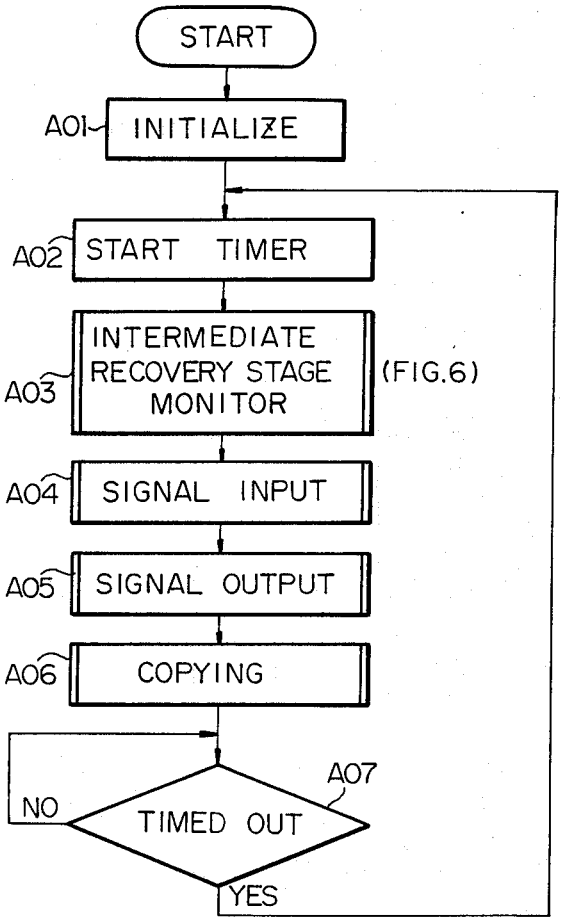
FIG. 5 is a flowchart showing an example of the main routine program to be executed by the central processing unit included in the control circuit illustrated in FIG. 4.

FIG. 5 shows the main routine program to be executed by the central processing unit 120. The routine program starts with the copying apparatus switched in and first initializes the central processing unit 120 at a step A01 so that all the operational parameters to be controlled by means of the central processing unit 120 are set in accordance with prescribed "default" rules. An internal timer of the system is then initiated at a step A02 to count the time interval predetermined for a single complete iteration through the routine program.

The central processing unit 120 may then execute an intermediate copy-sheet recovery stage monitoring subroutine program A03, the details of which will be described with reference to FIG. 6. The subroutine program A03 may be followed by a signal input subroutine program A04 by means of which signals from various detector and control switches are to be loaded into the random-access memory 124. The signals thus loaded into the memory 124 may include the copy-sheet size signals $S_{SZ1}$ and $S_{SZ2}$ supplied from the copy-sheet size detector switches 100 provided at the first and second main copysheet supply stages, respectively, and the copy-sheet size signal $S_{SZ3}$ supplied from the copy-sheet size detector switch 100 provided at the intermediate copy-sheet recovery stage. The signals loaded into the memory 124 by the subroutine program A04 may further include the duplex mode select signal $S_{DX}$ supplied from the duplex mode select switch 118 on the control panel 104 and the signal $S_{TR}$ supplied from the duplex tray detector switch 102 and indicative of the presence of the duplex copy-sheet supply tray 66 assembled to the apparatus.

The central processing unit 120 may further execute a signal output subroutine program A05 by which signals are output for activating the size select switches/indicators 116 to indicate the selected size of copy sheets. By the subroutine program A05 may be further output signals which include those for activating the indicators on the control panel 104, the various driver and actuator units, and the lamps and chargers of the document scanning and image reproducings systems 14 and 16. The central processing unit 120 may then execute various steps to process the instruction signals from any of the control and detector switches as by a subroutine program A06. Upon lapse of the predetermined time interval as detected at a step A07 after the internal timer of the system has been initiated at the step A02, the system reverts to the step A02 and may recycle the subroutine programs A03 to A06.

Description will be hereinafter made with reference to FIG. 6 in regard to the intermediate copy-sheet recovery stage monitoring subroutine program A03 included in the main routine program for the central processing unit 120.

Figure 6:
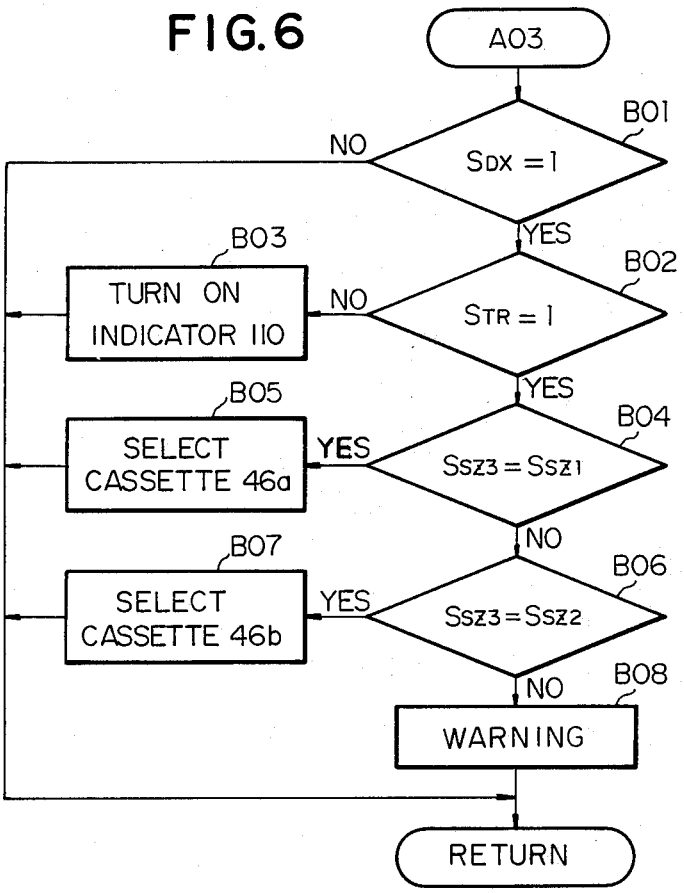
FIG. 6 is a flowchart showing the details of the intermediate copy-sheet recovery stage monitoring subroutine program included in the main routine program illustrated in FIG. 5.

Referring to FIG. 6, the intermediate copy-sheet recovery stage monitoring subroutine program A03 starts with a decision step B01 to determine whether or not an duplex copy mode of operation is currently requested from the control panel 104. This decision is made on the basis of the signal $S_{DX}$ received from the duplex mode select switch 118 on the control panel 104. In the presence of the duplex mode select signal $S_{DX}$ of logic "1" state, it is determined that there currently is a request for a duplex copy mode of operation and the system proceeds to another decision step B02 to confirm whether or not there is a duplex copy-sheet supply tray installed at the intermediate copy-sheet recovery stage of the apparatus. The decision by this step B02 is made on the basis of the signal $S_{TR}$ received from the duplex tray detector switch 102. In the presence of the signal $S_{TR}$ of logic "0" state, it is determined that there is no duplex copy-sheet supply tray installed at the intermediate copy-sheet recovery stage. In this instance, an instruction signal is issued at a step B03 so that the duplex tray indicator 110 associated with the intermediate copy-sheet recovery stage is turned on to flicker for requesting installation of the duplex copy-sheet supply tray 66 for any copy-sheet size. This request is cancelled either when the duplex copy-sheet supply tray 66 is properly installed on the apparatus or when the request for the duplex copying mode is withdrawn by the operator.

If the answer for the step B02 is given in the affirmative by the signal $S_{TR}$ of logic "1" state, it is further queried at a step B04 whether or not the copy sheet size represented by the signal $S_{SZ3}$ from the detector switch 100 at the intermediate copy-sheet recovery stage coincides with the copy sheet size represented by the signal $S_{SZ1}$ from the detector switch 100 at the first main copy-sheet supply stage. If it is found that the copy sheet sizes respectively represented by the signals $S_{SZ3}$ and $S_{SZ1}$ are coincident with each other, an instruction signal is issued at a step B05 so that the cassette **46*a* installed at the first main copy-sheet supply stage is selected for supplying the copy sheets. At this step B05 are further activated the cassette indicator 106 associated with the first main copy-sheet supply stage, any one of the size select switches/indicators 116 for indicating the size of copy sheets stored in the cassette 46*a* and one of the copy-sheet direction indicators 112 and 114** for indicating whether a copy-sheet is to be fed either lengthwise or widthwise.

If it is found at the step B04 that the copy sheet sizes respectively represented by the signals $S_{SZ3}$ and $S_{SZ1}$ are not coincident with each other, it is now queried at a step B06 whether or not the copy sheet size represented by the signal $S_{SZ3}$ from the detector switch 100 at the intermediate copysheet recovery stage coincides with the copy sheet size represented by the signal $S_{SZ2}$ from the detector switch 100 at the second main copy-sheet supply stage. If it is found that the copy sheet sizes respectively represented by the signals $S_{SZ3}$ and $S_{SZ2}$ are coincident with each other, an instruction signal is issued at a step B07 so that the cassette **46*b* installed at the first main copy-sheet supply stage is selected for supplying the copy sheets. At this step B07 are further activated the cassette indicator 108 associated with the second main copy-sheet supply stage, any one of the size select switches/indicators 116 for indicating the size of copy sheets stored in the cassette 46*b* and one of the copy-sheet direction indicators 112 and 114** for indicating whether a copy-sheet is to be fed lengthwise or widthwise.

If it is found at the step B06 that the copy sheet sizes respectively represented by the signals $S_{SZ3}$ and $S_{SZ2}$ are not coincident with each other, an instruction signal is issued at a step B08 so that one of the size select switches/indicators 116 and the indicators 112/114 are turned on to flicker for warning that there is no proper copy-sheet supply cassette installed in the apparatus. This warning lasts until the proper copy-sheet supply cassette is installed, the duplex copy-sheet supply tray 66 currently set in the apparatus is exchanged with a new one so that coincidence is achieved between the signals $S_{SZ3}$ and $S_{SZ1}$ or between the signals $S_{SZ3}$ and $S_{SZ2}$, or the request for the duplex mode of copying mode is cancelled.

As will have been understood from the foregoing description, a copying apparatus according to the present invention is characterized in that, of the cassettes **46*a* and 46*b* installed at the main copy-sheet supply stages, only the cassette allocated to the copy-sheet size coincident with the copy-sheet size predetermined for the duplex copy-sheet supply tray 66 currently installed at the intermediate copy-sheet recovery stage is selected for use in the duplex mode of copying operation. This selection is made in an automatic fashion under the control of the central processing unit 120 insofar as the cassette installed at one of the main copy-sheet supply stages is found acceptable for the duplex copy-sheet supply tray 66 in use. The operator of the copying apparatus according to the present invention is thus permitted to keep his hand off the control panel 104 of the apparatus once he has manipulated the duplex mode select switch 118 on the panel 104. In the event there is found no proper cassette installed at the main copysheet supply stages of the apparatus, the operator is informed of the fact from the flickering of an indicator on the control panel 104** and may then take any appropriate steps.

Figure 7:
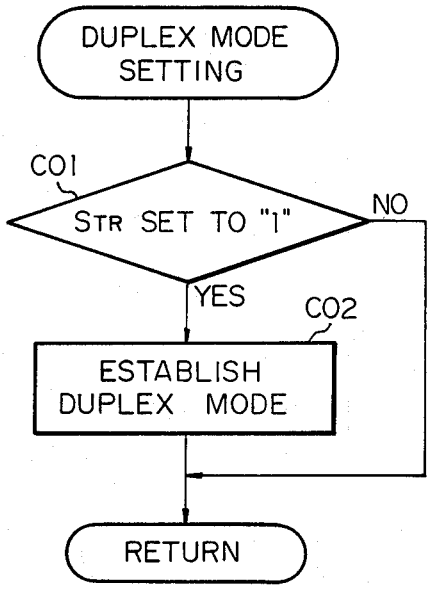
FIG. 7 is a flowchart a subroutine program which may be added to the main routine program illustrated in FIG. 5.

While it has been assumed that a duplex mode of copying operation is selectable solely from the duplex mode select switch 118 on the control panel 104, such a mode of operation may be established automatically upon detection of the duplex copy-sheet supply tray 66 assembled to the intermediate copysheet recovery stage of the apparatus. FIG. 7 is a flowchart showing the subroutine program for the establishment of a duplex mode of copying operation in such a manner. The subroutine program herein shown may be executed prior to, for example, the intermediate copy-sheet recovery stage monitoring subroutine program A03 in the main routine program described with reference to FIG. 5.

Referring to FIG. 7, the duplex mode setting subroutine program starts with a decision step C01 at which is confirmed whether or not a duplex copy-sheet supply tray 66 has just been assembled to the intermediate copy-sheet recovery stage of the apparatus. The decision by this step C01 is made on the basis of the transition in the logic state of the signal $S_{TR}$ received from the duplex tray detector switch 102 provided at the intermediate copy-sheet recovery stage of the apparatus. In response to the transition of the signal $S_{TR}$ from logic "0" to logic "1" state, it is determined that there is the duplex copy-sheet supply tray 66 installed at the intermediate copysheet recovery stage. In this instance, a signal is issued at a step C03 to inform the central processing unit 120 that a duplex mode of copying operation is to be established. It will be apparent that, insofar as the duplex copy-sheet supply tray 66 has just been installed at the intermediate copy-sheet recovery stage, a duplex mode of copying operation can not be newly set up by this subroutine program.

It has been assumed in the foregoing description that any one of the duplex copy-sheet supply trays respectively available for different sizes of copy sheets is selected and detachably assembled to the apparatus depending on the size of the copy sheets selected to be used. If desired, however, a single duplex copy-sheet supply tray having an adjustable sheet retainer plate may be used and fixedly attached to the apparatus so that copy sheets of any desired size may be received by and supplied from the tray.

It may be further noted that some prohibitive means may be provided which is operative to prohibit selection and accordingly execution of a duplex mode of copying operation in the absence of a duplex copy-sheet supply tray at the intermediate copy-sheet recovery stage of the apparatus.

What is claimed is:

1. An image duplicating apparatus including (a) means for reproducing images on a sheet medium,
(b) a plurality of sheet feeding means each for feeding a sheet medium to the image reproducing means, the sheet feeding means being respectively operative to store sheet media of different predetermined sizes,
(c) first control means for controlling said image reproducing means so that the image reproducing means reproduces images on one of the opposite faces of a sheet medium fed from one of said plurality of sheet feeding means,
(d) sheet recovery and supply means for temporarily storing the sheet medium having images reproduced on one of its faces under the control of said first control means and thereafter supplying the sheet medium for a second time to said image reproducing means, and
(e) second control means for controlling said image reproducing means so that the image reproducing means reproduces images on the other face of the sheet medium supplied from said sheet recovery and supply means,
wherein the improvement comprises
(f) first size indicating means for indicating the size of the sheet media stored in each of said plurality of sheet feeding means,
(g) second size indicating means for indicating the size of the sheet media which can be stored in said sheet recovery and supply means, and
(h) sheet-feed selecting means for comparing the size of sheet media indicated by said first size indicating means and the size of sheet media indicated by said second size indicating means and automatically selecting the particular one of said plurality of sheet feeding means that stores sheet media of the size identical with the size of sheet media indicated by said second size indicating means.

2. An image duplicating apparatus as set forth in claim 1, in which said image reproducing means and said sheet feeding means form part of a main unit of said apparatus, said sheet recovery and supply means being detachable from said main unit.

3. An image duplicating apparatus as set forth in claim 2, further comprising detecting means for detecting whether or not said sheet recovery and supply means is held in an operative position within said duplicating apparatus.

4. An image duplicating apparatus as set forth in claim 3, further comprising warning means for producing a warning signal when it is detected by said detecting means that said sheet recovery and supply means is not held in said operative position within said duplicating apparatus.

5. An image duplicating apparatus as set forth in claim 4, in which said warning means is operative to cease production of said warning signal when it is detected by said detecting means that said sheet recovery and supply means is installed into said operative position within said duplicating apparatus.

6. An image duplicating apparatus as set forth in claim 1, further comprising manual select means for permitting manual selection of one of said plurality of sheet feeding means.

7. An image duplicating apparatus as set forth in claim 6, in which said sheet-feed selecting means is operable without respect to the manual selection of one of said plurality of sheet feeding means by said manual select means.

8. An image duplicating apparatus as set forth in claim 1, further comprising warning means for producing a warning signal in the absence of the sheet feeding means which stores sheet media of the size identical with the size of sheet media indicated by said second size indicating means.

9. An image duplicating apparatus as set forth in claim 8, in which at least one of the sizes of the sheet media to be stored respectively by said plurality of said sheet feeding means and said sheet recovery and supply means is alterable, said warning means being operative to cease production of said warning signal when it is detected that the sizes of sheet media respectively indicated by said first and second size indicating means are identical with each other after at least one of the sizes of the sheet media to be stored respectively by said plurality of said sheet feeding means and said sheet recovery and supply means has been altered.

10. An image duplicating apparatus, comprising
(a) means for reproducing images on a sheet medium, the image reproducing means being operable selectively in one of modes of operation including
an ordinary copying mode for reproducing an image on a single face of a sheet medium, and
a duplex copying mode for reproducing an image on the opposite faces of a sheet medium,
(b) mode selecting means for selecting one of said modes of operation,
(c) a plurality of sheet feeding means each for feeding a sheet medium to the image reproducing means, the sheet feeding means being respectively operative to store sheet media of different predetermined sizes,
(d) first size indicating means for indicating the size of the sheet media stored in each of said plurality of sheet feeding means,
(e) sheet recovery and supply means for temporarily storing the sheet medium having images reproduced on one of its faces and thereafter supplying the sheet medium for a second time to said image reproducing means when said duplex copying mode is selected by said mode selecting means,
(f) second size indicating means for indicating the size of the sheet media which can be stored in said sheet recovery and supply means, and
(g) means for automatically selecting the particular one of said plurality of sheet feeding means that stores sheet media of the size identical with the size of sheet media indicated by said second size indicating means when said duplex copying mode is selected by said mode selecting means.

11. An image duplicating apparatus as set forth in claim 10, in which said image reproducing means and said sheet feeding means form part of a main unit of said apparatus, said sheet recovery and supply means being detachable from said main unit.

12. An image duplicating apparatus as set forth in claim 11, further comprising detecting means for detecting whether or not said sheet recovery and supply means is held in an operative position within said duplicating apparatus.

13. An image duplicating apparatus as set forth in claim 12, further comprising warning means for producing a warning signal when it is detected by said detecting means that said sheet recovery and supply means is not held in said operative position within said duplicating apparatus.

14. An image duplicating apparatus as set forth in claim 13, in which said warning means is operative to cease production of said warning signal when it is detected that said duplex copying mode is cancelled.

15. An image duplicating apparatus as set forth in claim 13, in which said warning means is operative to cease production of said warning signal when it is detected by said detecting means that said sheet recovery and supply means is installed into said operative position within said duplicating apparatus.

16. An image duplicating apparatus as set forth in claim 12, further comprising means for automatically selecting said duplex copying mode when it is detected by said detecting means that said sheet recovery and supply means is installed into said operative position within said duplicating apparatus.

17. An image duplicating apparatus as set forth in claim 10, further comprising manual select means for permitting manual selection of one of said plurality of sheet feeding means.

18. An image duplicating apparatus as set forth in claim 17, in which said sheet-feed selecting means is operable without respect to the manual selection of one of said plurality of sheet feeding means by said manual select means.

19. An image duplicating apparatus as set forth in claim 10, further comprising warning means for producing a warning signal in the absence of the sheet feeding means which stores sheet media of the size identical with the size of sheet media indicated by said second size indicating means when said duplex copying mode is selected by said mode selecting means.

20. An image duplicating apparatus as set forth in claim 19, in which at least one of the sizes of the sheet media to be stored respectively by said plurality of said sheet feeding means and said sheet recovery and supply means is alterable, said warning means being operative to cease production of said warning signal when it is detected that the sizes of sheet media respectively indicated by said first and second size indicating means are identical with each other after at least one of the sizes of the sheet media to be stored respectively by said plurality of said sheet feeding means and said sheet recovery and supply means has been altered.

21. An image duplicating apparatus, comprising (a) means for reproducing images on a sheet medium, the image reproducing means being operable selectively in one of modes of operation including
an ordinary copying mode for reproducing an image on a single face of a sheet medium, and
a duplex copying mode for reproducing an image on the opposite faces of a sheet medium, (b) mode selecting means for manually selecting one of said modes of operation, (c) sheet feeding means for feeding a sheet medium to the image reproducing means, (d) sheet recovery and supply means for temporarily storing the sheet medium having images reproduced on one of its faces and thereafter supplying the sheet medium for a second time to said image reproducing means when said duplex copying mode is selected by said mode selecting means, (e) said image reproducing means and said sheet feeding means forming part of a main unit of said apparatus, said sheet recovery and supply means being detachable from said main unit, and (f) means for detecting whether or not said sheet recovery and supply means is held in an operative position within said duplicating apparatus and automatically selecting said duplex copying mode and when the sheet recovery and supply means is installed in the operative position.

22. An image duplicating apparatus as set forth in claim 21, further comprising (g) first size indicating means for indicating the size of the sheet media stored in said sheet feeding means, (h) second size indicating means for indicating the size of the sheet media which can be stored in said sheet recovery and supply means, and (i) control means for controlling said image reproducing means on the basis of information representative of the sizes of sheet media respectively indicated by said first and second second size indicating means.

23. An image duplicating apparatus as set forth in claim 22, in which the combination of said sheet feeding means and said first size indicating means is one of a plurality of such combinations which are provided respectively for different predetermined sizes of sheet media, said control means being operative to select the sheet feeding means of the particular one of said plurality of combinations which corresponds to the size of sheet media indicated by said second size indicating means.

* * * * *